US010570493B2

(12) United States Patent
Kim et al.

(10) Patent No.: US 10,570,493 B2
(45) Date of Patent: Feb. 25, 2020

(54) STEEL SHEET FOR HOT PRESS FORMING WITH EXCELLENT CORROSION RESISTANCE AND WELDABILITY, FORMING MEMBER, AND MANUFACTURING METHOD THEREFOR

(71) Applicant: POSCO, Pohang-si, Gyeongsangbuk-do (KR)

(72) Inventors: Myung-Soo Kim, Gwangyang-si (KR); Hyeon-Seok Hwang, Gwangyang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 0 days.

(21) Appl. No.: 15/105,498

(22) PCT Filed: Dec. 23, 2014

(86) PCT No.: PCT/KR2014/012698
§ 371 (c)(1),
(2) Date: Jun. 16, 2016

(87) PCT Pub. No.: WO2015/099399
PCT Pub. Date: Jul. 2, 2015

(65) Prior Publication Data

US 2017/0002450 A1 Jan. 5, 2017

(30) Foreign Application Priority Data

Dec. 23, 2013 (KR) ..... 10-2013-0161323

(51) Int. Cl.
*B32B 15/00* (2006.01)
*C23C 2/12* (2006.01)
(Continued)

(52) U.S. Cl.
CPC ..... *C23C 2/12* (2013.01); *C22C 21/06* (2013.01); *C22C 21/08* (2013.01); *C22C 38/00* (2013.01);
(Continued)

(58) Field of Classification Search
None
See application file for complete search history.

(56) References Cited

U.S. PATENT DOCUMENTS 6,579,615 B1 6/2003 Sugimaru et al.
6,649,282 B1 * 11/2003 Yamaguchi ..... C22C 13/00 428/621
(Continued)

FOREIGN PATENT DOCUMENTS

CN 1327484 A 12/2001
CN 1362997 A 8/2002
(Continued)

OTHER PUBLICATIONS

Extended European Search Report dated Dec. 8, 2016 issued in European Patent Application No. 14874709.0.
(Continued)

*Primary Examiner* — Seth Dumbris
(74) *Attorney, Agent, or Firm* — Morgan, Lewis & Bockius LLP

(57) ABSTRACT

The present invention relates to: a steel sheet for hot press forming that is used for vehicle parts and the like and, more particularly, to a steel sheet for hot press forming with excellent corrosion resistance and weldability; a forming member; and a manufacturing method therefor.

9 Claims, 1 Drawing Sheet

(51) Int. Cl.

| | |
|---|---|
| ***C23C 2/26*** | (2006.01) |
| ***C22C 21/08*** | (2006.01) |
| ***C22C 38/00*** | (2006.01) |
| ***C22C 21/06*** | (2006.01) |

(52) U.S. Cl.
CPC ..... *C23C 2/26* (2013.01); *Y10T 428/12736* (2015.01); *Y10T 428/12757* (2015.01)

(56) References Cited

U.S. PATENT DOCUMENTS

| | | | | |
|---|---|---|---|---|
| 8,932,729 | B2 | 1/2015 | Kawata et al. | |
| 2003/0003321 | A1 | 1/2003 | Sugimaru et al. | |
| 2009/0297387 | A1* | 12/2009 | Chin | C21D 9/48 420/79 |
| 2012/0152411 | A1* | 6/2012 | Morimoto | B22D 11/115 148/533 |

FOREIGN PATENT DOCUMENTS

| | | | | | |
|---|---|---|---|---|---|
| CN | 103131911 | A | | 6/2013 | |
| EP | 1013785 | A1 | | 6/2000 | |
| EP | 1380666 | A1 | | 1/2004 | |
| EP | 2980262 | A1 | | 2/2016 | |
| EP | 2993248 | A1 | | 3/2016 | |
| JP | 11279734 | A | * | 10/1999 | C23C 2/12 |
| JP | H11-279734 | A | | 10/1999 | |
| JP | 2001-073108 | A | | 3/2001 | |
| JP | 2004-083988 | | * | 3/2004 | C22C 21/04 |
| JP | 2004-083988 | A | | 3/2004 | |
| JP | 2012112010 | | * | 2/2012 | C23C 2/12 |
| JP | 2012-112010 | A | | 6/2012 | |
| JP | 5327410 | B1 | | 10/2013 | |
| JP | 2013-227620 | A | | 11/2013 | |
| KR | 10-2009-0020751 | A | | 2/2009 | |
| KR | 10-2013-0161323 | | | 7/2015 | |
| WO | 2008/025066 | A1 | | 3/2008 | |
| WO | 2008/053273 | A1 | | 5/2008 | |
| WO | 2009/131267 | A1 | | 10/2009 | |

OTHER PUBLICATIONS

International Search Report dated Mar. 19, 2015 issued in International Patent Application No. PCT/KR2014/012698 (English translation).
Chinese Office Action dated Mar. 5, 2018 issued in Chinese Patent Application No. 201480070527.X.
European Notice of Opposition dated Nov. 27, 2019 issued in European Patent Application No. 14874709.0 (with English translation).
Wikipedia Article, "Nombre d'oxydation," archived version of May 13, 2012, pp. 1-5 (with English translation).
Webpage—https://www.rsc.org/periodic-table/12/magnesium, archived version of Oct. 27, 2013.
Webpage—https://www.rsc.org/periodic-table/element/4/bervllium, archived version of Oct. 17, 2013.
Webpage—https://www.rsc.org/periodic-table/element/20/calcium, archived version of Oct. 17, 2013.
Webpage—https://www.rsc.org/periodic-table/element/3/lithium, archived version of Oct. 17, 2013.
Webpage—https://www.rsc.org/periodic-table/element/11/sodium, archived version of Oct. 17, 2013.
Webpage—https://www.rsc.org/periodic-tablefelement/13/aluminium, archived version of Oct. 17, 2013.
"StandardSpecification for Steel Sheet, Aluminum-Coated, by the Hot-Dip Process," ASTM A463 Standard, 2010 version, pp. 1-6.
R. W. Richards, et al., "Metallurgy of continuous hot dip aluminising" vol. 39, No. 5, published in 1994, pp. 191-212.
D. W. Fan, et al., "Formation of aluminide coating on hot stamped steel" Graduate Institute of Ferrous Technology, Pohang University of Science and Technology, published in 2010, pp. 1713-1718.
M. Windmann, et al., "Phase formation at the interface between a boron alloyed substrate and an Al-rich coating" Surface and Coating Technology, vol. 226, published in 2013, pp. 130-139.
L. WeiKang, et al., "Influence of heating parameters on the properties of Al-Si coating applied to hot stamping," Science China Techological Sciences, Jul. 2017, vol. 60, No. 7, pp. 1088-1102.
F. Jenner et al. "Evolution of Phases and Microstructure during Heat Treatment of Aliminized Low Carbon Steel," Material Science and Technology, Oct. 5-9, 2008, pp. 1722-1732.

* cited by examiner

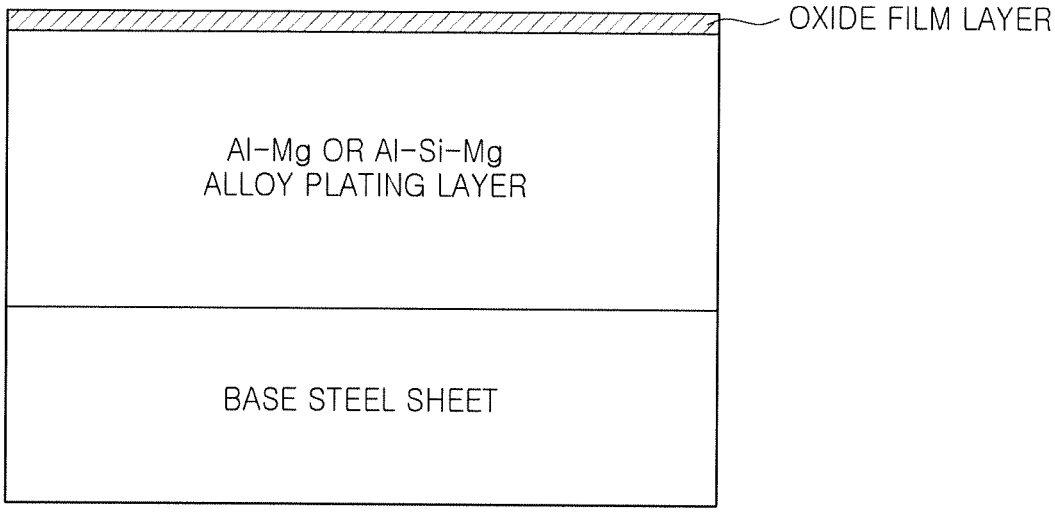
OXIDE FILM LAYER
Al-Mg OR Al-Si-Mg
ALLOY PLATING LAYER
BASE STEEL SHEET

STEEL SHEET FOR HOT PRESS FORMING WITH EXCELLENT CORROSION RESISTANCE AND WELDABILITY, FORMING MEMBER, AND MANUFACTURING METHOD THEREFOR

RELATED APPLICATIONS

This application is the U.S. National Phase under 35 U.S.C. § 371 of International Application No. PCT/KR2014/012698, filed on Dec. 23, 2014, which in turn claims the benefit of Korean Patent Application No. 10-2013-0161323 filed on Dec. 23, 2013, the disclosure of which applications are incorporated by reference herein.

TECHNICAL FIELD

The present disclosure relates to a steel sheet for hot press forming used for a vehicle component or the like, and more particularly, to a steel sheet for hot press forming with excellent corrosion resistance and weldability, a hot press forming member, and a method of manufacturing the same.

BACKGROUND ART

Recently, usage of high strength steel has been continuously increased to reduce the weight of vehicles, but abrasion and fracturing of steel sheets may easily occur if high strength steel is processed at room temperature. In addition, in the middle of processing, a springback phenomenon may occur, whereby it may be difficult to process dimensions precisely. Thus, hot press forming (HPF) is applied as one preferable method of processing high strength steel without defects.

Hot press forming (HPF) is a method of processing a steel sheet at high temperature to have a complex shape by using properties in which the steel sheet is able to be softened and becomes highly ductile at high temperatures and, more particularly, is a method of manufacturing a product having high strength and a precise shape, as a structure of a steel sheet is transformed to a structure of martensite by performing processing and quenching at the same time, after the steel sheet is heated to a temperature beyond that of an austenite region, in other words, in a state in which a phase transition is possible.

Meanwhile, if the high strength steel is heated to a high temperature, a surface defect, such as corrosion, decarburization or the like may occur in a surface of the steel. To prevent the surface defect, after zinc-based or aluminum-based plating is performed on the surface of the steel, hot press forming (HPF) is performed. In this case, zinc (Zn) or aluminum (Al) used for a plating layer serves to protect a steel sheet from the external environment, thereby improving corrosion resistance of the steel sheet.

An aluminum-plated steel sheet has an advantage of not forming a thick oxide film on a plating layer, even at a high temperature, due to a high melting point of Al and a dense and thin Al oxide film formed on an upper part of the plating layer. On the other hand, a zinc-plated steel sheet has an excellent effect of protecting a steel sheet from corrosion, even by a scratch of a cross section or a surface due to self-sacrificing corrosion resistance of zinc. Such self-sacrificing corrosion resistance of the zinc-plated steel sheet is better than that of the aluminum-plated steel sheet. Thus, corrosion resistance improving effects of the zinc-plated steel sheet are better than those of the aluminum-plated steel sheet. Thus, hot press forming (HPF) using the zinc-plated steel sheet on behalf of the aluminum-plated steel sheet, has been proposed.

However, if the zinc-plated steel sheet is heated to a temperature above an austenite transformation temperature to undertake hot press forming, as a heating temperature is higher than a melting point of a zinc layer, in other words, a zinc plating layer, zinc may be in a liquid state for a predetermined time on a surface of a steel sheet. In this case, if such liquid zinc is present on the surface of the steel sheet during processing of the steel sheet in a press, tensile stress may occur in the surface of the steel sheet, whereby a grain boundary of base iron may be drenched with the liquid zinc. The zinc with which the grain boundary is drenched allows binding force of an interface to be weak. Thus, the interface may act as a region in which a crack occurs under tensile stress. A phenomenon in which a propagation velocity of the crack generated in the surface of the steel sheet may be relatively rapid and the crack may be deeply propagated in comparison with base iron according to the related art, may occur.

Such a phenomenon is called known as a liquid brittle fracture, and the phenomenon may cause a problem of material degradation such as a fatigue fracture, bending properties degradation and the like, whereby the liquid brittle fracture should be avoided. To date, in the hot press forming of zinc-plated steel sheets, the problem of the liquid brittle fracture has not yet been fundamentally solved.

Furthermore, to improve corrosion resistance of an aluminum-plated steel sheet or an aluminum-silicon alloy plated steel sheet, a method of alloy plating magnesium (Mg) is used. Since an aluminum-magnesium alloy plated steel sheet and an aluminum-silicon-magnesium alloy plated steel sheet manufactured therefrom have excellent corrosion resistance by itself, such sheets are used for building materials and materials for forming vehicle components.

However, if a plated steel sheet on which Al and Mg are alloy plated is heat treated at a temperature above 900° C. for hot press forming, Mg is diffused toward a surface of a plating layer during the heating process, thereby forming a magnesium oxide (MgO) on the surface. This oxide may have a low degree of adhesion, and a portion of the oxide may be adhered to a forming die, thereby contaminating the die. Furthermore, MgO adhered to a surface of a formed article after forming, may serve as resistance in a process in which the formed article is resistance welded, thereby causing a welding defect.

DISCLOSURE

Technical Problem

An aspect of the present disclosure is to provide a steel sheet for hot press forming capable of negating existing disadvantages of a steel sheet for hot press forming, and having excellent corrosion resistance and weldability simultaneously, a hot press forming member using the same, and a method of manufacturing the same.

Technical Solution

According to an aspect of the present disclosure, a steel sheet for hot press forming may include: a base steel sheet, and an aluminum-magnesium alloy plating layer formed on at least one surface of the base steel sheet. The aluminum-magnesium alloy plating layer may include an element having a higher degree of oxidation than a degree of oxidation of magnesium (Mg) included in the aluminum-magnesium alloy plating layer.

According to another aspect of the present disclosure, a hot press forming member may include: a base steel sheet; an aluminum-magnesium alloy plating layer formed on at least one surface of the base steel sheet; and an oxide film layer formed in an upper part of the aluminum-magnesium alloy plating layer. The oxide film layer may include an element having a higher degree of oxidation than a degree of oxidation of magnesium (Mg) included in the aluminum-magnesium alloy plating layer.

According to another aspect of the present disclosure, a method of manufacturing a steel sheet for hot press forming may include: preparing a base steel sheet; and forming an alloy plating layer by submerging the base steel sheet in an aluminum-magnesium alloy plating bath. The aluminum-magnesium alloy plating bath may include 0.5 wt % to 10 wt % of magnesium (Mg), 0.0005 wt % to 0.05 wt % of an element having a higher degree of oxidation than the magnesium (Mg), and aluminum (Al) as a residual component thereof, and inevitable impurities.

Advantageous Effects

According to an exemplary embodiment in the present disclosure, a steel sheet for hot press forming may be a steel sheet having improved corrosion resistance as compared to a plated steel material for hot press forming according to the related art. A hot press forming member without surface defects and the like in hot press forming may be manufactured using the steel sheet for hot press forming. The hot press forming member may allow a defect in a case of welding to be significantly reduced due to excellent weldability of the hot press forming member and may secure welding stability.

DESCRIPTION OF DRAWINGS

FIG. 1 is a cross-sectional schematic view of a hot press forming member according to an exemplary embodiment in the present disclosure.

BEST MODE FOR INVENTION

In a case in which magnesium (Mg) plating is performed to improve corrosion resistance of an aluminum-plated steel sheet for hot press forming or an aluminum-silicon plated steel sheet for hot press forming, when high temperature heating for hot pressing, Mg is diffused toward a surface of a plating layer, thereby forming MgO on the surface of the plating layer. The oxide may cause corrosion resistance and weldability of the plated steel sheet to be decreased.

Accordingly, the inventors have conducted research into using Mg alloy plating in order to improve corrosion resistance of plated steel sheets, and suppressing oxide formation due to Mg when high temperature heating for hot press forming of alloy plated steel sheets manufactured therefrom. As a result of the research, in a case in which Mg and elements having a greater degree of oxidation than that of Al and Mg are additionally added to an Al-based plating bath, an alloy plated steel sheet in which corrosion resistance and weldability are improved is confirmed to be able to be manufactured, leading to the present disclosure.

Hereinafter, the present disclosure will be described in detail.

According to an exemplary embodiment in the present disclosure, a steel sheet for hot press forming may include a base steel sheet and an aluminum-magnesium alloy plating layer formed on at least one surface of the base steel sheet.

First, according to an exemplary embodiment in the present disclosure, the base steel sheet for a steel sheet for hot press forming may be a steel sheet applied to general hot press forming and, for example, carbon steel according to the related art may be used therein. As an example of the carbon steel, a steel sheet including 0.1 wt % to 0.4 wt % of carbon (C), 0.05 wt % to 1.5 wt % of silicon (Si), 0.5 wt % to 3.0 wt % of manganese (Mn), andiron (Fe) as a residual component thereof, and inevitable impurities, but is not limited thereto.

According to an exemplary embodiment in the present disclosure, the base steel sheet may further include one or more selected from a group consisting of 0.001 wt % to 0.02 wt % of nitrogen (N), 0.0001 wt % to 0.01 wt % of boron (B), 0.001 wt % to 0.1 wt % of titanium (Ti), 0.001 wt % to 0.1 wt % of niobium (Nb), 0.001 wt % to 0.01 wt % of vanadium (V), 0.001 wt % to 1.0 wt % of chromium (Cr), 0.001 wt % to 1.0 wt % of molybdenum (Mo), 0.001 wt % to 0.1 wt % of antimony (Sb), and 0.001 wt % to 0.3 wt % of tungsten (W) in addition to the above described elements in order to improve mechanical properties such as strength, toughness, weldability, and the like of steel.

According to an exemplary embodiment in the present disclosure, the steel sheet for hot press forming may preferably include a plating layer formed on at least one surface of the above described base steel sheet. In this case, the plating layer may preferably be an aluminum-magnesium alloy plating layer. In this case, a magnesium content inside the alloy plating layer may be 0.5 wt % to 10 wt %.

Meanwhile, the aluminum-magnesium alloy plating layer may further include 10 wt % or less (excluding 0 wt %) of silicon (Si). In this case, the alloy plating layer may preferably be an aluminum-silicon-magnesium alloy plating layer.

The alloy plating layer may preferably have an average thickness of 5 μm to 30 μm. In a case in which an average thickness of the alloy plating layer is less than 5 μm, corrosion resistance of the plated steel sheet may not be sufficiently secured. On the other hand, in a case in which an average thickness of the alloy plating layer is greater than 30 μm, corrosion resistance may be secured, but an amount of plating may be excessively increased and costs of manufacturing a steel sheet may be increased.

The alloy plating layer may preferably include aluminum, magnesium, silicon, and an element having a greater degree of oxidation than the magnesium (Mg) as a composition thereof.

The element having a greater degree of oxidation than the magnesium (Mg) may preferably be one or more of beryllium (Be), calcium (Ca), lithium (Li), sodium (Na), strontium (Sr), scandium (Sc), and yttrium (Y) and, more preferably, one or more selected from a group consisting of beryllium (Be), calcium (Ca), lithium (Li), and sodium (Na).

The element having a greater degree of oxidation than the magnesium (Mg), for example, Be, Ca, Li, Na, or the like, is an element having a greater degree of oxidation than that of the aluminum, the magnesium, and the silicon. In a case in which the steel sheet for hot press forming according to an exemplary embodiment in the present disclosure including above described elements, is heated at a high temperature, the elements having a greater degree of oxidation than the above described magnesium (Mg) may be diffused toward a surface of a plating layer in advance. Thus, a problem of an Mg alloy plated steel sheet, in other words, degradation of corrosion resistance and weldability due to formation of MgO when high temperature heating, may be prevented. To this end, the steel sheet may preferably include 0.0005 wt % to 0.05 wt % of the element having a greater degree of oxidation than the magnesium (Mg) and, more preferably, may include 0.0005 wt % to 0.02 wt % of the element having a greater degree of oxidation than the magnesium (Mg).

Hereinafter, a method of manufacturing a steel sheet for hot press forming according to an exemplary embodiment in the present disclosure will be described as a preferable example.

A steel sheet for hot press forming provided according to an exemplary embodiment in the present disclosure may be manufactured including preparing a base steel sheet, and forming an alloy plating layer as the base steel sheet is dipped in an aluminum-magnesium alloy plating bath including an element having a higher degree of oxidation than magnesium (Mg).

First, the base steel sheet may preferably be a steel described above in an exemplary embodiment in the present disclosure. The method of manufacturing the base steel sheet is not particularly limited, and the base steel sheet may be manufactured and prepared according to a known method in the art.

As the prepared base steel sheet is dipped in an aluminum-magnesium alloy plating bath, an alloy plating layer may preferably be formed on at least one surface of the base steel sheet.

A process of forming the alloy plating layer may be performed for 2 seconds to 5 seconds in an alloy plating bath at 650° C. to 750° C.

In a case in which a temperature of the alloy plating bath is less than 650° C., an appearance of the plating layer may be poor and plating adhesion may be degraded. On the other hand, in a case in which a temperature of the alloy plating bath is greater than 750° C., thermal diffusion of the base steel sheet may be increased, thereby causing abnormal growth of an alloy layer. Thus, workability may be decreased and an oxide layer inside a plating bath may be excessively generated.

In addition, in a case in which a dipped time is less than 2 seconds, sufficient plating may not occur. Thus, a plating layer having a required thickness may not be formed. On the other hand, in a case in which a dipped time is greater than 5 seconds, an alloy layer may be abnormally grown which may not preferable.

In a case in which an alloy plating layer is formed as plating is performed under the above described conditions, in order to form an alloy plating layer having a composition desired in an exemplary embodiment in the present disclosure, the alloy plating bath may preferably include 0.5 wt % to 10 wt % of magnesium (Mg), 0.0005 wt % to 0.05 wt % (5 ppm to 500 ppm) of the element having a higher degree of oxidation than the magnesium (Mg), and aluminum (Al) as a residual component thereof, and inevitable impurities.

In a case in which plating is performed using the alloy plating bath, a base steel sheet may be eluted in the plating bath, whereby a portion of elements of the base steel sheet may present as impurities in the plating bath. More particularly, 3 wt % or less of Fe, 3 wt % or less of Mg, and 0.1 wt % or less of one or more elements of Ni, Cu, Cr, P, S, V, Nb, Ti, and B, respectively, may be included in the plating bath as impurities.

In this case, the element having a higher degree of oxidation than the magnesium (Mg) may preferably be one or more of beryllium (Be), calcium (Ca), lithium (Li), sodium (Na), strontium (Sr), scandium (Sc), and yttrium (Y), and, more preferably, one or more selected from a group consisting of beryllium (Be), calcium (Ca), lithium (Li), and sodium (Na).

Mg included in the alloy plating bath is an element important for improvement of corrosion resistance. In a case in which an aluminum-based plated steel sheet is exposed to a corrosive environment, a surface of a plating layer and an exposed portion of base iron are covered with a corrosion-inhibiting product including Mg, thereby improving inherent corrosion resistance of the aluminum-based plated steel sheet.

In a case in which a content of Mg inside a plating bath is less than 0.5 wt %, a content of Mg inside an alloy plating layer formed after plating may be less than 0.5 wt %. In this case, corrosion resistance of a formed article after hot press forming may be degraded. On the other hand, in a case in which a content of Mg inside a plating bath is greater than 10 wt %, dross generation may be increased.

In addition, in a case in which a content of an element having a higher degree of oxidation than the magnesium (Mg) is less than 0.0005 wt %, a content of the elements inside an alloy plating layer formed after plating may be less than a minimum content desired in an exemplary embodiment in the present disclosure. In this case, in a case in which high temperature heating, an effect of suppressing MgO generation caused by surface diffusion of Mg inside an alloy plating layer, may be significantly reduced, thereby causing facility contamination caused by falling of MgO during a hot press process. In addition, as a content of Mg inside an alloy plating layer of a final formed article is significantly reduced, corrosion resistance may not be secured. On the other hand, in a case in which a content of an element having a higher degree of oxidation than the magnesium (Mg) is greater than 0.05 wt %, elements having a higher degree of oxidation than the magnesium (Mg) may be partially concentrated in an interface between a plating layer and base iron. In this case, in high temperature heating of the elements, a concentrated product in the interface may allow an alloy reaction of the base iron and the plating layer to be suppressed, thereby delaying alloying with the base iron. In a case in which alloying is delayed, the plating layer may be partially dissolved in a process of heating to a high temperature, whereby the plating layer dissolved in hot pressing may be adhered to a die. More advantageously, 0.0005 wt % to 0.02 wt % of the element having a higher degree of oxidation than the magnesium (Mg) may be more preferably included in the alloy plating bath.

According to an exemplary embodiment in the present disclosure, a small amount of an element having a higher degree of oxidation than magnesium (Mg), for example, one or more of Be, Ca, Li, and Na, may be added to an alloy plating bath mainly including Mg in addition to Al, thereby further improving corrosion resistance of a formed alloy plated steel sheet. In other words, the elements such as Be, Ca, Li, and Na are elements having an excellent degree of oxidation in comparison with aluminum and magnesium. After plating is completed inside the alloy plating bath, in a case of heating to a high temperature, the elements may be diffused toward a surface of a plating layer in advance, thereby suppressing oxide formation caused by Mg. As a result, corrosion resistance of an alloy plated steel sheet may be improved.

Meanwhile, inside the alloy plating layer, 10 wt % or less (excluding 0 wt %) of silicon (Si) may be further included in addition to the above described element. In a case in which a plated steel sheet is heated to a high temperature, the Si may allow excessive diffusion of base iron to be suppressed, thereby suppressing falling of a plating layer in a hot press process. In addition, the Si may serve to improve fluidity of a plating bath.

An alloy plating layer formed after plating is completed inside the above described alloy plating bath, may be an aluminum-magnesium alloy plating layer or an aluminum-silicon-magnesium alloy plating layer. Inside each alloy plating layer, an element having a higher degree of oxidation than the magnesium (Mg) may preferably be, for example, one or more of beryllium (Be), calcium (Ca), lithium (Li), sodium (Na), strontium (Sr), scandium (Sc), and yttrium (Y) and, preferably, 0.0005 wt % to 0.05 wt % and, more preferably, 0.0005 wt % to 0.02 wt % of one or more selected from a group consisting of beryllium (Be), calcium (Ca), lithium (Li), and sodium (Na).

Hereinafter, a hot press forming member manufactured using a steel sheet for hot press forming according to an exemplary embodiment in the present disclosure, and a method of manufacturing the same will be described in detail.

First, a hot press forming member according to an exemplary embodiment in the present disclosure may be obtained by hot press forming a steel sheet for hot press forming according to an exemplary embodiment in the present disclosure. More particularly, as illustrated in FIG. 1, the hot press forming member may include a base steel sheet; an aluminum-magnesium alloy plating layer formed on at least one surface of the base steel sheet; and an oxide film layer formed in an upper part of the alloy plating layer.

The oxide film layer may be formed as elements forming an aluminum-magnesium alloy plating layer of the steel sheet for hot press forming is diffused toward a surface of a plating layer. In addition, the oxide film layer may preferably include an element having a higher degree of oxidation than the magnesium (Mg), and may include one or more of aluminum and magnesium.

In addition, a portion of the element having a higher degree of oxidation than the magnesium (Mg) may be included inside the aluminum-magnesium alloy plating layer.

In this case, the element having a higher degree of oxidation than the magnesium (Mg) may preferably be one or more of beryllium (Be), calcium (Ca), lithium (Li), sodium (Na), strontium (Sr), scandium (Sc), and yttrium (Y), and, more preferably, one or more selected from a group consisting of beryllium (Be), calcium (Ca), lithium (Li), and sodium (Na).

A thickness of an oxide film layer formed as described above may preferably be 1 μm or less (excluding 0 μm). In a case in which the thickness of the oxide film layer exceeds 1 μm, weldability may be degraded in spot welding.

Meanwhile, the alloy plating layer may further include 10 wt % or less (excluding 0 wt %) of silicon (Si). In this case, a portion of silicon may be included inside an oxide film layer formed in an upper part of the alloy plating layer.

Next, according to an exemplary embodiment in the present disclosure, a method of manufacturing a hot press forming member will be described in detail.

As described above, a hot press forming member including an alloy plating layer and an oxide film layer in order in a surface of a base steel sheet, may be manufactured including: heating a steel sheet for hot press forming according to an exemplary embodiment in the present disclosure; hot press forming the steel sheet for hot press forming; and cooling the steel sheet for hot press forming.

The heating process may preferably be performed at a temperature rising rate of 3° C./s to 200° C./s until Ac3 to 1000° C.

The heating may allow a microstructure of a steel sheet to be a structure of austenite. In a case in which the temperature is lower than an Ac3 transformation temperature, the temperature may be to be within a two phase region. On the other hand, in a case in which the temperature exceeds 1000° C., an alloy plating layer may be partially degraded, which may not preferable.

In addition, heating until the temperature of Ac3 to 1000° C. may be preferably performed at a temperature rising rate of 3° C./s to 200° C./s. In a case in which a temperature rising rate is less than 3° C./s, more time may be required to reach a heating temperature. Thus, the heating may be preferably performed at a rate of 3° C./s or more. In this case, an upper limit of the temperature rising rate may be preferably set as 200° C./s in consideration of a heating device.

In a process of heating under above described conditions, elements included inside a base steel sheet and an alloy plating layer may be diffused toward a surface of a plating layer. Particularly, an element having a higher degree of oxidation than magnesium (Mg), included in the alloy plating layer, for example one or more elements of Be, Ca, Li, and Na may be diffused in advance, thereby forming an oxide film layer having a thickness of 1 μm or less (excluding 0 μm). In this case, a portion of aluminum, magnesium, silicon, and the like which may be easily diffused toward a surface of a plating layer, may be further included in addition to above described elements, inside the oxide film layer.

Meanwhile, according to an exemplary embodiment in the present disclosure, after the heating process, the heating temperature may be maintained for a period of time to secure a target material as required. In this case, the maintained time may not be particularly limited, but the maintained time may preferably be 240 seconds or less in consideration of a diffusion time of base iron, and the like.

As described above, after heating is completed, a hot press forming member may be manufactured by performing hot press forming.

In this case, a method generally used in the art may be used for hot press forming. For example, while the heating temperature is maintained, the heated steel sheet may be hot press formed in a required form using a press, but is not limited thereto.

After the hot press forming is completed, cooling may be preferably performed at a cooling rate of 20° C./s or more until 100° C. or less. In this case, cooling may be advantageous as a rate of the cooling is faster. In a case in which the cooling rate is less than 20° C./s, a structure in which strength is low such as ferrite or pearlite may be formed, which may not be preferable.

A steel sheet for hot press forming according to an exemplary embodiment in the present disclosure may have excellent corrosion resistance. A hot press forming member without surface defects or the like may be manufactured in hot press forming by using the steel sheet. The hot press forming member may have excellent weldability, thereby significantly reducing defects in welding and securing welding stability.

BEST MODE FOR INVENTION

Hereinafter, the present disclosure will be described through exemplary embodiments in more detail. However, the following exemplary embodiments are provided to describe the present disclosure in more detail, but not intended to limit the scope of the present disclosure. It is because that the scope of the present disclosure is determined by aspects described in the claims and aspects reasonably inferred therefrom.

Embodiment

First, a cold rolled steel sheet for hot press forming having a thickness of 15 mm was prepared as a base steel sheet. In this case, the base steel sheet included C: 0.22 wt %, Si: 0.24 wt %, Mn: 1.56 wt %, P: 0.012 wt %, B: 0.0028 wt %, Cr: 0.01 wt %, Ti: 0.03 wt %, andiron (Fe) as a residual component thereof, and inevitable impurities as elements.

The base steel sheet was heated to 800° C. for an annealing heat treatment, after the base steel sheet was maintained at the temperature for 50 seconds and then cooled, and the base steel sheet was dipped in a plating bath maintained at a temperature of 690° C. In this case, a composition of the plating bath is the same as described in Table 1.

After the plating was completed, a plating layer was dissolved, and a plating weight and an element were analyzed. The plating weight and the element were converted into a thickness, thereby measuring a total thickness of the plating layer. The result thereof is described in Table 2.

In addition, after the each plated steel sheet was heated under conditions described in Table 3 and forming is completed within 10 seconds, the plated steel sheet in a formed state was cooled, thereby manufacturing a formed article.

And then, a thickness of an oxide film layer formed on a surface of the formed article was measured, and a corrosion depth of base iron was measured by performing a neutral salt spray test for 1200 hours. Thus, the result thereof is described in Table 3.

TABLE 1

| Classification | | Plating bath element (wt %) |
|---|---|---|
| Inventive Example | 1 | Mg: 1%, Be: 0.002%, Al as a residual component, and inevitable impurities |
| | 2 | Mg: 2%, Be: 0.01%, Al as a residual component, and inevitable impurities |
| | 3 | Mg: 5%, Be: 0.04%, Al as a residual component, and inevitable impurities |
| | 4 | Mg: 3%, Ca: 0.01%, Al as a residual component, and inevitable impurities |
| | 5 | Mg: 6%, Si: 3%, Be: 0.02%, Al as a residual component, and inevitable impurities |
| | 6 | Mg: 8%, Si: 8%, Be: 0.01%, Li: 0.005%, Al as a residual component, and inevitable impurities |
| | 7 | Mg: 3%, Si: 5%, Be: 0.005%, Na: 0.001%, Al as a residual component, and inevitable impurities |
| Comparative Example | 1 | Mg: 7%, Al as a residual component, and inevitable impurities |
| | 2 | Mg: 7%, Si: 8%, Al as a residual component, and inevitable impurities |
| | 3 | Mg: 8%, Be: 0.0001%, Al as a residual component, and inevitable impurities |
| | 4 | Mg: 5%, Be: 0.2%, Al as a residual component, and inevitable impurities |
| | 5 | Mg: 5%, Be: 0.003%, Al as a residual component, and impurities |

TABLE 2

| Classification | | Plating bath element (wt %) | Plating layer thickness |
|---|---|---|---|
| Inventive Example | 1 | Mg: 1.05%, Be: 0.0025%, Al as a residual component, and impurities | 11 μm |
| | 2 | Mg: 1.95%, Be: 0.011%, Al as a residual component, and impurities | 14 μm |
| | 3 | Mg: 5.2%, Be: 0.041%, Al as a residual component, and impurities | 9 μm |
| | 4 | Mg: 2.8%, Ca: 0.0106%, Al as a residual component, and impurities | 10 μm |
| | 5 | Mg: 6.2%, Si: 3.05%, Be: 0.022%, Al as a residual component, and impurities | 22 μm |
| | 6 | Mg: 8.3%, Si: 7.95%, Be: 0.012%, Li: 0.006%, Al as a residual component, and impurities | 15 μm |
| | 7 | Mg: 3.04%, Si: 5.1%, Be: 0.0054%, Na: 0.0011%, Al as a residual component, and impurities | 17 μm |
| Comparative Example | 1 | Mg: 7.1%, Al as a residual component, and impurities | 10 μm |
| | 2 | Mg: 7.3%, Si: 7.98%, Al as a residual component, and impurities | 14 μm |
| | 3 | Mg: 8.1%, Be: 0.00015%, Al as a residual component, and impurities | 16 μm |
| | 4 | Mg: 4.88%, Be: 0.21%, Al as a residual component, and impurities | 9.3 μm |
| | 5 | Mg: 5.1%, Be: 0.0031%, Al as a residual component, and impurities | 2.5 μm |

TABLE 3

| | | Hot press (forming) conditions | | | | After forming | | |
|---|---|---|---|---|---|---|---|---|
| | | | | | | | Surface | |
| Classification | | Heating temperature (° C.) | Average temperature rising rate (° C./s) | Maintained time (s) | Cooling rate (° C./s) | Die contamination degree | oxidative film layer thickness | Corrosion resistance (Corrosion depth, mm) |
| Inventive Example | 1 | 900 | 8 | 120 | 30 | good | 0.34 μm | 0.32 |
| | 2 | 880 | 15 | 100 | 30 | good | 0.08 μm | 0.31 |
| | 3 | 880 | 70 | 150 | 25 | good | 0.13 μm | 0.28 |
| | 4 | 930 | 30 | 30 | 60 | good | 0.37 μm | 0.30 |
| | 5 | 900 | 8 | 200 | 90 | good | 0.15 μm | 0.11 |
| | 6 | 900 | 8 | 100 | 30 | good | 0.26 μm | 0.18 |
| | 7 | 900 | 8 | 150 | 30 | good | 0.28 μm | 0.21 |

TABLE 3-continued

| Classification | | Hot press (forming) conditions | | | | After forming | | |
|---|---|---|---|---|---|---|---|---|
| | | Heating temperature (° C.) | Average temperature rising rate (° C./s) | Maintained time (s) | Cooling rate (° C./s) | Die contamination degree | Surface oxidative film layer thickness | Corrosion resistance (Corrosion depth, mm) |
| Comparative Example | 1 | 900 | 8 | 150 | 30 | contamination | 1.9 μm | 0.54 |
| | 2 | 900 | 8 | 150 | 30 | contamination | 1.6 μm | 0.52 |
| | 3 | 900 | 8 | 150 | 30 | good | 1.2 μm | 0.51 |
| | 4 | 900 | 8 | 150 | 30 | contamination | 0.21 μm | 0.32 |
| | 5 | 900 | 1 | 200 | 30 | good | 1.1 μm | 0.67 |

As described in Tables 1 to 3, in a case of a hot press forming process using a plated steel sheet manufactured under conditions according to an exemplary embodiment in the present disclosure, facility contamination did not occur. In addition, all thicknesses of a surface oxide film layer after hot press forming were formed as 0.37 μm or less. In addition, as result of evaluating corrosion resistance with respect to each of formed articles, all corrosion depths were 0.32 mm or less. Thus, that corrosion resistance was confirmed to be excellent.

On the other hand, like comparative examples 1 and 2, in a case in which any element of Be, Ca, Li, and Na was not included in a plating bath, facility contamination after forming was severe. In addition, a thickness of an oxide film layer exceeded 1 μm and the oxide film layer was formed to be thick. Thus, corrosion depths were 0.54 mm and 0.52 mm, respectively, and corrosion resistance was confirmed to be inferior.

In a case of a comparative example 3, Be was included in a plating bath, but a content of Be is significantly low. In a high-temperature heating process for hot press forming, a surface oxidation suppressing effect of Mg was weak, whereby an oxide film layer was thickly formed. Thus, corrosion resistance was inferior.

In a case of a comparative example 4, a large amount of Be was included in a plating bath, Be concentrated at an interface in a high temperature heating process for hot press forming, allowed diffusion of base iron to be suppressed, thereby suppressing alloying of a plating layer. Thus, a portion of the plating layer was in a liquid state during a pressing process, and the liquid was attached to a forming die, thereby contaminating a die.

In a case of a comparative example 5, plating bath conditions were consistent with an exemplary embodiment in the present disclosure, but a temperature rising rate was significantly slow in heating for hot press. Due to heating for a long period of time, an oxide film layer was thickly formed, whereby corrosion resistance was inferior.

The invention claimed is:

1. A steel sheet for hot press forming, comprising:

a base steel sheet including: 0.1 wt % to 0.4 wt % of carbon (C), 0.05 wt % to 1.5 wt % of silicon (Si), 0.5 wt % to 3.0 wt % of manganese (Mn), one or more selected from a group consisting of 0.001 wt % to 0.02 wt % of nitrogen (N), 0.0001 wt % to 0.01 wt % of boron (B), 0.001 wt % to 0.1 wt % of titanium (Ti), 0.001 wt % to 0.1 wt % of niobium (Nb), 0.001 wt % to 0.01 wt % of vanadium (V), 0.001 wt % to 1.0 wt % of chromium (Cr), 0.001 wt % to 1.0 wt % of molybdenum (Mo), 0.001 wt % to 0.1 wt % of antimony (Sb) and 0.001 wt % to 0.3 wt % of tungsten (W), and iron (Fe) as a residual component thereof, and inevitable impurities; and an aluminum-magnesium alloy plating layer formed on at least one surface of the base steel sheet, wherein the aluminum-magnesium alloy plating layer consists of aluminum and magnesium as principal components and 0.0005 wt % to 0.05 wt % of an element having a higher degree of oxidation than a degree of oxidation of magnesium (Mg) included in the aluminum-magnesium alloy plating layer and inevitable impurities, wherein the element having a higher degree of oxidation than a degree of oxidation of the magnesium (Mg) is one or more selected from a group consisting of beryllium (Be), lithium (Li), and sodium (Na).

2. The steel sheet for hot press forming of claim 1, wherein the aluminum-magnesium alloy plating layer includes 0.0005 wt % to 0.02 wt % of the element having a higher degree of oxidation than the magnesium (Mg).

3. The steel sheet for hot press forming of claim 1, wherein the aluminum-magnesium alloy plating layer includes 0.5 wt % to 10 wt % of magnesium (Mg).

4. The steel sheet for hot press forming of claim 1, wherein the aluminum-magnesium alloy plating layer has an average thickness of 5 μm to 30 μm.

5. A hot press forming member comprising:

a base steel sheet including: 0.1 wt % to 0.4 wt % of carbon (C), 0.05 wt % to 1.5 wt % of silicon (Si), 0.5 wt % to 3.0 wt % of manganese (Mn), one or more selected from a group consisting of 0.001 wt % to 0.02 wt % of nitrogen (N), 0.0001 wt % to 0.01 wt % of boron (B), 0.001 wt % to 0.1 wt % of titanium (Ti), 0.001 wt % to 0.1 wt % of niobium (Nb), 0.001 wt % to 0.01 wt % of vanadium (V), 0.001 wt % to 1.0 wt % of chromium (Cr), 0.001 wt % to 1.0 wt % of molybdenum (Mo), 0.001 wt % to 0.1 wt % of antimony (Sb) and 0.001 wt % to 0.3 wt % of tungsten (W), and iron (Fe) as a residual component thereof, and inevitable impurities;

an aluminum-magnesium alloy plating layer formed on at least one surface of the base steel sheet, wherein the aluminum-magnesium alloy plating layer consists of aluminum and magnesium as principal components and 0.0005 wt % to 0.05 wt % of an element having a higher degree of oxidation than a degree of oxidation of magnesium (Mg) included in the aluminum-magnesium alloy plating layer and inevitable impurities, and wherein the element having a higher degree of oxidation than a degree of oxidation of the magnesium (Mg)

is one or more selected from a group consisting of beryllium (Be), lithium (Li), and sodium (Na); and an oxide film layer formed in an upper part of the aluminum-magnesium alloy plating layer, wherein the oxide film layer includes an element having a higher degree of oxidation than a degree of oxidation of magnesium (Mg) included in the aluminum-magnesium alloy plating layer.

6. The hot press forming member of claim 5, wherein the element having a higher degree of oxidation than a degree of oxidation of the magnesium (Mg) is one or more selected from a group consisting of beryllium (Be), calcium (Ca), lithium (Li), and sodium (Na).

7. The hot press forming member of claim 5, wherein the oxide film layer further comprises one or more of aluminum and magnesium.

8. The hot press forming member of claim 5, wherein the aluminum-magnesium alloy plating layer has an average thickness of 5 μm to 35 μm, and the oxide film layer has an average thickness of 1 min or less (excluding 0 μm).

9. A method of manufacturing a steel sheet for hot press forming, comprising:

preparing a base steel sheet including: 0.1 wt % to 0.4 wt % of carbon (C), 0.03 wt % to 1.5 wt % of silicon (Si), 0.5 wt % to 3.0 wt % of manganese (Mn), one or more selected from a group consisting of 0.001 wt % to 0.02 wt % of nitrogen (N), 0.0001 wt % to 0.01 wt % of boron (B), 0.001 wt % to 0.1 wt % of titanium (Ti), 0.001 wt % to 0.1 wt % of niobium (Nb), 0.001 wt % to 0.01 wt % of vanadium (V), 0.001 wt % to 1.0 wt % of chromium (Cr), 0.01 wt % to 1.0 wt % of molybdenum (Mo), 0.001 wt % to 0.1 wt % of antimony (Sb) and 0.001 wt % to 0.3 wt % of tungsten (W), and iron (Fe) as a residual component thereof and inevitable impurities; and forming an alloy plating layer by dipping the base steel sheet in an aluminum-magnesium alloy plating bath, wherein the alloy plating layer consists of aluminum and magnesium as principal components and 0.0005 wt % to 0.05 wt % of an element having a higher degree of oxidation than a degree of oxidation of magnesium (Mg) included in the aluminum-magnesium alloy plating layer and inevitable impurities and wherein the element having a higher degree of oxidation than a degree of oxidation of the magnesium (Mg) is one or more selected from a group consisting of beryllium (Be), lithium (Li), and sodium (Na).

* * * * *